United States Patent [19]

Henning et al.

[11] Patent Number: 5,052,415

[45] Date of Patent: Oct. 1, 1991

[54] PROCESS FOR THE IMPREGNATION OF FIBERS OF A TOBACCO SMOKE FILTER WITH DICARBOXYLIC OR POLYCARBOXYLIC ACIDS OR ANHYDRIDES THEREOF

[75] Inventors: Paul-Georg Henning, Quickborn; Gerald Schmekel, Elmshorn, both of Fed. Rep. of Germany

[73] Assignee: B.A.T. Cigarettenfabriken GmbH, Fed. Rep. of Germany

[21] Appl. No.: 356,340

[22] Filed: May 24, 1989

[30] Foreign Application Priority Data

Jun. 13, 1988 [DE] Fed. Rep. of Germany ..... 3820089

[51] Int. Cl.[5] ..... A24D 3/14; A24D 3/16

[52] U.S. Cl. ..... 131/331; 131/342; 131/343; 131/345

[58] Field of Search ..... 131/343, 342, 331, 345

[56] References Cited

U.S. PATENT DOCUMENTS

| | | | |
|---|---|---|---|
| 2,780,228 | 2/1957 | Touey | 131/345 |
| 3,618,619 | 11/1971 | Kiefer | 131/343 |

FOREIGN PATENT DOCUMENTS

| | | |
|---|---|---|
| 1051182 | 2/1959 | Fed. Rep. of Germany . |
| 1300854 | 8/1969 | Fed. Rep. of Germany . |
| 1956949 | 6/1970 | Fed. Rep. of Germany . |

*Primary Examiner*—V. Millin

*Attorney, Agent, or Firm*—Irell & Manella

[57] ABSTRACT

Fibers of tobacco smoke filters which have been impregnated with dicarboxylic or polycarboxylic acids or anhydrides thereof can be obtained by dissolving anhydrides of dicarboxylic or polycarboxylic acids in volatile or physiologically acceptable organic solvents and applying them to the fibers and, if appropriate, hydrolyzing them with water.

8 Claims, No Drawings

PROCESS FOR THE IMPREGNATION OF FIBERS OF A TOBACCO SMOKE FILTER WITH DICARBOXYLIC OR POLYCARBOXYLIC ACIDS OR ANHYDRIDES THEREOF

TECHNICAL FIELD

The invention relates to a process for the impregnation of fibers of a tobacco smoke filter with dicarboxylic or polycarboxylic acids or anhydrides thereof.

BACKGROUND

It is known to treat fibers of tobacco smoke filters with acid components in order to adsorb basic constituents of the tobacco smoke. Thus DE-C 1,300,854 describes the treatment of the filter fibers with acid esters of organic polycarboxylic acids, such as citric acid, tartaric acid, succinic acid, malic acid and sugar acids, for this purpose. These acid esters can be finely divided on the fibers together with glycerol triacetate. DE-C 1,051,182 relates to the treatment of filter fibers based on cellulose with alginic acid and pectic acid. Finally, DE-A 1,956,949 describes the impregnation of filter fibers with tartaric acid.

In general, the previously known processes suffer from the disadvantage that the solvents and/or hardeners, such as glycerol triacetate (triacetin), which are customary in the preparation of filters in the cigarette industry are poor solvents of dicarboxylic or polycarboxylic acids. The process of the invention is aimed at the elimination of this disadvantage.

DISCLOSURE OF THE INVENTION

The process comprises dissolving anhydrides of the dicarboxylic or polycarboxylic acids in volatile or physiologically acceptable organic solvents and applying them to the fiber and, if appropriate, hydrolyzing them with water. Since the anhydrides of the dicarboxylic or polycarboxylic acids are more readily soluble in the customary organic solvents than the corresponding acids, the corresponding carboxylic acids can be precipitated by hydrolysis onto the fibers to be treated. A very homogeneous treatment or coating of the fibers is achieved at the same time thereby, the precipitated dicarboxylic or polycarboxylic acids having a large adsorption surface. The water required for the hydrolysis can be added separately; the hydrolysis can, however, also be effected at least in part with water which adheres to the filter material. Furthermore, the hydrolysis is not absolutely necessary; the fibers can also be treated with the anhydrides alone, which then as such act as adsorption agents. In the course of this, chemical reactions between the anhydrides and the fiber material can also result, if the latter contains reactive hydroxyl groups.

MODES FOR CARRYING OUT THE INVENTION

In principle, any volatile solvents which dissolve the anhydrides more readily than the corresponding dicarboxylic or polycarboxylic acids and which can be removed easily after the precipitation of the latter can be employed for the process of the invention. It is preferable, however, to use those physiologically acceptable organic solvents which are in any case required in the preparation of filters, in particular carboxylic acid esters also known as "hardeners," preferably those selected from the group composed of polyethylene glycol acetates or propionates, in particular triethylene glycol diacetate, glycerol diacetate, glycerol triacetate, glycerol dipropionate, glycerol tripropionate, di(methoxyethyl) phthalate, methyl ethylphthalyl glycolate and triethyl citrate. It is also possible to employ mixtures of the said esters.

Fibers to be impregnated which are selected from the group composed of cellulose acetate, cellulose and polypropylene are particularly suitable for the process of the invention.

Anhydrides which can be employed in accordance with the process of the invention are, in particular, those of dicarboxylic or polycarboxylic acids which form cyclic anhydrides; also substituted derivatives of such anhydrides, for example 0-acyl derivatives of hydroxysubstituted dicarboxylic or polycarboxylic anhydrides.

Anhydrides which are preferred for the process of the invention are those selected from the group composed of maleic anhydride, succinic anhydride, glutaric anhydride, tartaric anhydride, malic anhydride, aconitic anhydride, citric anhydride and acetyl citric anhydride. It is also possible to employ mixtures of these anhydrides.

The use of maleic anhydride or citric anhydride or the acetyl derivative of the latter, the use of cellulose acetate fibers and the use of glycerol triacetate as the solvent is particularly preferred.

In another advantageous embodiment of the invention, it is possible to expose the fibers which have been impregnated with the solvents containing the dissolved anhydrides to an environment of high humidity. In this case, the hydrolysis of the anhydrides is effected by the absorption of water from the environment. Alternatively, it is also possible to add the amount of water required for the hydrolysis of the anhydrides to the solvents containing the anhydrides and to apply the resulting solution to the fibers before the precipitation of the hydrolysis products of the anhydrides. In this variant, the impregnation of the fibers should take place immediately after water has been added to the solution, in order to prevent premature precipitation of the hydrolysis products. Determination of the interval of time available for this between the addition of water and processing depends on the hydrolysis kinetics and on the proportion of water and anhydride, the temperature of the solution of anhydride, the presence of catalysts and the like, but determination can be effected without problems by those skilled in the art.

A further advantage of the process of the invention can be seen in the fact that the anhydrides can also react with free OH groups of cellulose acetate and cellulose. This produces a particularly good adhesion of the carboxylic acids to be precipitated on the fibers.

The invention is illustrated in greater detail below using preferred illustrative embodiments.

A continuous bank of filter (tow) of cellulose acetate was impregnated with the following solutions:

Solution A:

8 kg of triacetin, 1 kg of maleic anhydride & 183 g of $H_2O$

Solution B:

8 kg of triacetin, 2 kg of maleic anhydride & 367 g of $H_2O$

Solution C:

7 kg of triacetin, 3 kg of maleic anhydride & 551 g of $H_2O$

Solutions D, E & F:

Triacetin alone for comparison purposes.

The above-mentioned solutions A to C were prepared by initially introducing glycerol triacetate (triacetin) at ambient temperature and adding the appropriate amount of the anhydride slowly. After complete solution had been achieved, an equimolar amount of distilled water was added; the reaction product was stirred until it was single-phase. The solutions were capable of being used for approximately 5 hours. The resulting mixtures were poured into a triacetin storage vessel; filter rods of controlled weight were prepared using the various application concentrations collated in Table 1.

The coating was calculated as maleic acid in the table, 100% hydrolysis being assumed. The preparation of the filter rods was carried out briskly within the interval of time indicated, since crystals are precipitated above a certain concentration of maleic acid, so that processing is no longer possible. After a storage time to be determined, the filter tows can be used for the manufacture of cigarettes.

TABLE 1

| Filter Rod* | Triacetin (%)** | Maleic Acid (%)** | Note |
|---|---|---|---|
| A | 10.0 | 1.3 | |
| B | 8.8 | 2.6 | |
| C | 7.6 | 3.9 | |
| D | 10.4 | — | Comparison with A |
| E | 9.4 | — | Comparison with B |
| F | 8.1 | — | Comparison with C |

*Specification: length 126 mm, tensile strength 3 kPa, tow 3.0 Y/35000, filter casing IU 4000 (cm. min.$^{-1}$kPa$^{-1}$).
**% by weight, relative to the weight of filter tow.

Cigarettes were produced from the above filter rods and were test-smoked as specified in the DIN standard. The results collated in Table 2 were obtained:

TABLE 2

| Cigarette with filter according to Table 1 | Nicotine Retention by filter (%) | Nicotine (mg); main smoke | Note |
|---|---|---|---|
| A | 53 | 0.75 | |
| B | 54 | 0.73 | |
| C | 54 | 0.73 | |
| D | 39 | 0.94 | Comparison with A |
| E | 38 | 0.95 | Comparison with B |
| F | 35 | 0.97 | Comparison with C |

As can be seen from Table 2, the nicotine retention was increased by 20% in comparable cigarettes. It will also be realized that the filters operated within the "saturation region" and that no appreciable dependence on concentration can be detected within the treatment range selected. This means that, depending on the objective set, it is also possible to work with appreciably smaller amounts of the retention agent.

The cigarettes obtained above were subjected to a sensory test together with the comparison cigarettes. This resulted in reduced irritation, unchanged aroma character and constant fullness. The reduction of nicotine in the main smoke produced a lower sensation of impact.

The following solutions were prepared analogously to the solutions A to C described above:

Solution G:

8.6 kg of triacetin and 1.4 kg of acetylcitric anhydride

Solution H:

8.9 kg of triacetin and 1.1 kg of citric anhydride

Solution I:

9.4 kg of triacetin and 0.6 kg of citric anhydride.

The above-mentioned solutions were applied to filter tows and the latter were stored for two days at a high ambient humidity. Alternatively, the appropriate amount of distilled water was added to the solutions and the latter were applied immediately to the filter tows.

The filter rods collated in Table 3 were prepared. The results obtained with filter rods G to I when test-smoked as specified in the DIN standard have been collated in Table 4. In all cases a fiber material having a high retention of basic constituents of tobacco smoke was obtained. Filter rod J is a comparison product without added anhydride.

TABLE 3

| Filter Rod * | Triacetin (%)** | Anhydride of (%)** | Note |
|---|---|---|---|
| G | 8 | Acetyl citric acid (1.3) | |
| H | 8 | Citric acid (1.0) | |
| I | 8 | Citric acid (0.5) | |
| J | 8 | — | Comparison with G,H,I |

* Specification: Length 126 mm, tensile strength 3.9 kPa, tow 3.0 Y/35000, filter cladding 4000 IU (cm. min.$^{-1}$kPa$^{-1}$)
**% by weight, relative to the weight of the filter tow.

TABLE 4

| Cigarettes with filter according to Table 3 | Nicotine (mg) (main smoke) | Note |
|---|---|---|
| G | 0.76 | |
| H | 0.74 | |
| I | 0.85 | |
| J | 0.93 | Comparison with G, H and I |

We claim:

1. A process for the impregnation of fibers of a tobacco smoke filter with a dicarboxylic or polycarboxylic acid or anhydride thereof, which comprises;

applying a solution of a dicarboxylic or polycarboxylic acid anhydride in a volatile or physiologically acceptable organic solvent to the fibers, and exposing the fibers to an environment of high humidity.

2. The process of claim 1, wherein the fibers are selected from the group consisting of cellulose acetate, cellulose and polypropylene fibers.

3. The process of claim 1, wherein the solvent is selected from the group consisting of a polyethylene glycol acetate, a polyethylene glycol propionate, glycerol diacetate, glycerol triacetate, glycerol dipropionate, glycerol tripropionate, di(methoxyethyl) phthalate, methyl ethylphthalylglycolate and triethyl citrate.

4. The process of claim 1, wherein the anhydride is selected from the group consisting of maleic anhydride, succinic anhydride, glutaric anhydride, tartaric anhydride, malic anhydride, aconitic anhydride, citric anhydride and acetyl citric anhydride.

5. A process for the impregnation of fibers of a tobacco smoke filter with a dicarboxylic or polycarboxylic acid or anhydride thereof, which comprises:

preparing a solution of a dicarboxylic or polycarboxylic acid anhydride in a volatile or physiologically acceptable organic solvent;

adding to the solution an amount of water required for the hydrolysis of the anhydride; and applying the resulting solution to the fibers before the precipitation of the hydrolysis product of the anhydride.

6. The process of claim 5, wherein the fibers are selected from the group consisting of cellulose acetate, cellulose and polypropylene fibers.

7. The process of claim 5, wherein the solvent is selected from the group consisting of a polyethylene glycol acetate, a polyethylene glycol propionate, glycerol diacetate, glycerol triacetate, glycerol dipropionate, glycerol tripropionate, di(methoxyethyl) phthalate, methyl ethylphthalylglycolate and triethyl citrate.

8. The process of claim 5, wherein the anhydride is selected from the group consisting of maleic anhydride, succinic anhydride, glutaric anhydride, tartaric anhydride, malic anhydride, aconitic anhydride, citric anhydride and acetyl citric anhydride.

* * * * *